United States Patent [19]

Dennstädt et al.

[11] 4,100,772

[45] Jul. 18, 1978

[54] CONTINUOUS LEATHER PROCESSING MACHINE

[75] Inventors: Heinz Dennstädt, Oberursel; Walter Baum, Frankfurt, both of Fed. Rep. of Germany

[73] Assignee: USM Corporation, Farmington, Conn.

[21] Appl. No.: 846,028

[22] Filed: Oct. 27, 1977

[30] Foreign Application Priority Data

Nov. 4, 1976 [DE] Fed. Rep. of Germany ..... 2650576

[51] Int. Cl.[2] ..... C14B 17/00

[52] U.S. Cl. ..... 69/47; 69/44

[58] Field of Search ..... 69/42, 44, 47

[56] References Cited

U.S. PATENT DOCUMENTS

| | | | |
|---|---|---|---|
| 691,306 | 1/1902 | Chain et al. | 69/47 |
| 784,017 | 2/1905 | Turner | 69/44 |
| 791,006 | 5/1905 | Chain | 69/44 |
| 835,399 | 11/1906 | Chain | 69/44 |
| 3,796,070 | 3/1974 | Lyon | 69/44 |
| 4,037,437 | 7/1977 | Richter et al. | 69/42 |

FOREIGN PATENT DOCUMENTS

| | | | |
|---|---|---|---|
| 368,816 | 12/1906 | France | 69/47 |

*Primary Examiner*—Alfred R. Guest

*Attorney, Agent, or Firm*—Donald N. Halgren; Richard B. Megley; Vincent A. White

[57] ABSTRACT

The invention comprises a machine for the continuous processing of leather hides using a table board which is fed lengthways through at least one pair of processing tools lying parallel and opposite to each other. The leather hide to be processed is placed with its middle part around the front edge of a table board. The machine includes means for displacing with respect to the table board, the unprocessed middle strip of hide on the front edge of the table board, to permit it to be processed.

13 Claims, 13 Drawing Figures

CONTINUOUS LEATHER PROCESSING MACHINE

BACKGROUND OF THE INVENTION

1. Field of the Invention

This invention relates to leather processing machines, and more particularly to machines which permit the entire hide to be processed continuously.

2. Prior Art

Prior art leather processing devices have been constructed with two pairs of processing tools arranged one behind the other, wherein displacement of the leather hides around the front edge of a table board takes place in the gap between the two pairs or processing tools when the processing stock is out of contact with the processing tools. This type of guiding of the leather hides utilizing in particular, horizontal feed, a problem arises wherein the leather hides hang down from the table board on its underside in the mentioned gap and can thus slide off from the table board. Feeding the stock vertically on the table board still permits the possibility of the leather hides slipping, as they are never securely hung symmetrically balanced over the table board. In the case of horizontal guiding of the table board the problem of a safe intake when feeding the processing stock into the second pair of the processing tools arises. This safe intake can only be provided by a special support provided on the underside of the table board, otherwise the hides will hang down. The intermediate space between the two pairs of processing tools in the prior art necessitates a longer length of the entire machine, which is undesirable.

BRIEF SUMMARY OF THE INVENTION

The present invention includes a continuous leather processing machine having a particularly safe feed of the leather hides and a shortening of the machine length. The machine includes a pair of opposed processing tools one of which is permitted to maintain contact with the hide being processed, while the other processing tool is arranged to be removable for a defined time span permitting the hide in the mean time held by the other processing tool, to be displaced with respect to the table board by at least the width of the middle strip over the front edge of the table board.

The present invention enables the leather hide to be in constant contact with at least one processing tool and to be held secure thereby so that there can be no undesired slipping of the hide in relation to the table board. Controlled displacement of the hides around the front edge of the table board makes possible a shorter machine length than is the case with the prior art machines. Using two pairs of processing tools arranged in succession, one processing tool of the first pair can be lifted off the table board and the second pair may be arranged at such a distance from the first pair, that upon entry of the front edge of the table board between the second pair of processing tools after a given time span has expired permits the displacement of the middle strip to be completed. The spacing of the two pairs of processing tools therefore, can shrink up to the width of the middle strip to be displaced; if the removal of the respective processing tool of the first pair does not occur earlier, than when the front edge of the table board leaves the space between the first pair of processing tools.

The present invention also may comprise a continuous leather processing machine with only one pair of processing tools. In this case the time span commences after an intake length of leather hide corresponding to at least the width of the middle strip has passed between the processing tools and ends before the front edge of leather or the table board emerges from the processing tools. In this case, the machine is particularly small in length, as it contains only one pair of processing tools.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENT

Figure 1:
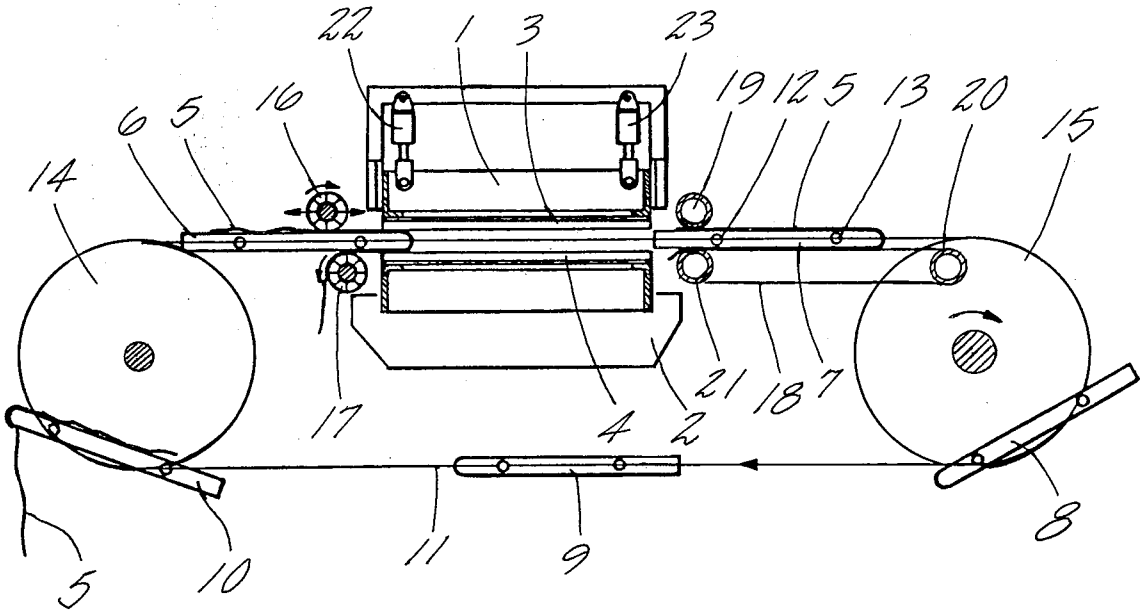
FIG. 1 shows a continuous leather processing machine in a side view, the machine comprising only one pair of processing tools with a table board and hide entering therebetween.

Referring now to the drawings, and particularly to FIG. 1, there is shown a continuous leather processing machine having a pair of processing tools 1 and 2 comprising an upper processing tool and a lower processing tool respectively, each of which are fitted with knife edges 3 and 4, backswept in the direction of passage. These knife edges 3 and 4 cause a spreading out of the leather hides or processing stock and cleaning thereof.

Using rounded knife edges in the present invention permits samming of the leathers, because the knife edges in this case do not cut but merely exert a local pressure on the leather to press out the water. Sharpened knife blades in the present invention permits the de-fleshing of the leather.

In the leather processing machine, an array of hides 5 may be serially fed between the processing tools 1 and 2. Each hide 5 is disposed over the front side of a table board 6 or 7. The processing tools 1 and 2 press against both the top and bottom sides of the boards 6 or 7 and therefor against the hides 5. The transporting of table boards 6 and 7 through the machine is effected by means of a pair of feed chains 11. The table boards 6 and 7 are attached to the feed chains 11 by an arrangement of bolts 12 and 13. The feed chains 11 are disposed about a first and a second guide wheel 14 and 15, respectively, which may result in a closed cycle for the movement of the table boards 6 and 7 through the machine. The table boards assume the positions shown by the further indicated table boards 8, 9 and 10. The hides overhang the table board in the position of the table board 10. The second guide wheel 15 is rotated clockwise in the direction of the arrow and the feed chain 11 moves through the machine in the direction of the indicated arrows causing a direction of movement of the hide 5 from left to right between the processing tools 1 and 2. A pair of rotating spreader rollers (stretchers) 16 and 17 are provided in the direction of passage in front of the processing tools 1 and 2. The spreaders 16 and 17 can be fitted with knife edges.

The spreader rollers 16 and 17 rotate in such a direction that they pull the hide 5 backwards contrary to the feed direction of the table board 6. A conveyor belt 18 is disposed downstream of the processing tools 1 and 2, and is arranged below the table board 7. The belt 18 supports the part of the hide lying under the table board 7 from below, to prevent the hide 5 from falling downward into the machine after leaving the processing tools 1 and 2. A pressure roller 19 is transversely disposed across the top of the hide 5 as it leaves the processing tools 1 and 2 to keep it pressed against the table board 7. The conveyor belt 18 is fed around a first and a second guide roller 20 and 21, respectively. Each guide roller is in the form of a pressure roller. After processing, the hide 5 on the table board 7 is transferred to the area of the second guide roller 20, where the hide 5 may be removed from the table board 7 using known means.

The upper processing tool 1 is arranged to be raised upwardly off the table board after the table board has been fed between the processing tools 1 and 2, to permit the processing of an as yet unprocessed middle strip 34 of the hide 5. The unprocessed middle strip 34 of the hide 5 is that portion of the hide 5 folded over the front leading edge of the table board. The upper processing tool 1 is movably supported from a suspension arrangement 22 and 23, shown in FIGS. 2 and 3, which can yield upwards against a spring tension or a pneumatic pressure. The upper processing tool 1 may be raised because of interaction between an arrangement of cams 24 and 25, which are part of the feed chain 11, and a pair of levers 26 and 27 which comprise supports for the processsing tool 1. The levers 26 and 27 are mounted at the one end in a stationary pivot bearing 28 or 29. A roller 30 or 31, is disposed at the other end of the levers 26 and 27, enabling them to be easily raised from the cams 24 and 25 when the feed chain 11 is advanced. The levers 26 and 27 pivotally support the processing tool 1. The processing tool 1 is attached to the levers 26 and 27 by a pivot bearing 32 and 33. The processing tool 1 is raised when the counter tension in the mounting devices 22 and 23 is overcome.

Figure 2:
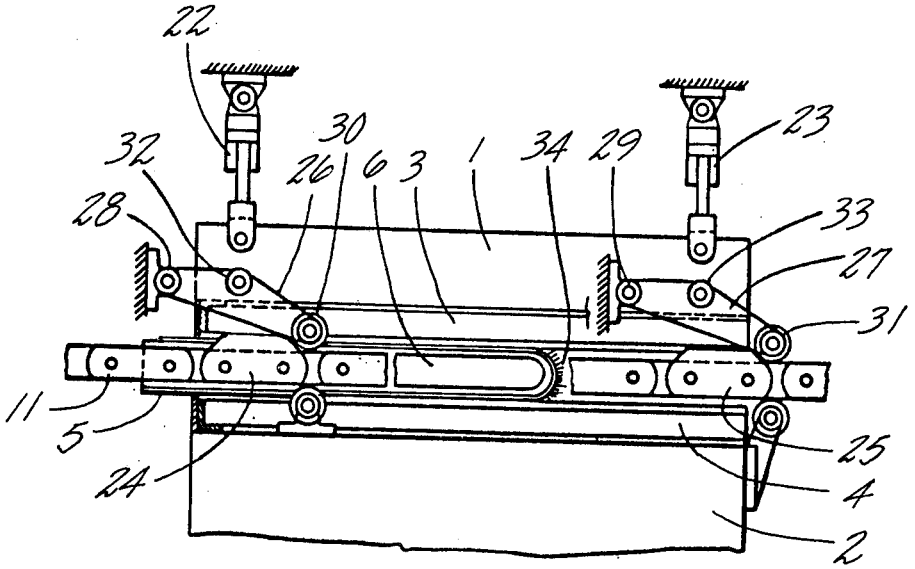
FIGS. 2 and 3 each show in a side view, a continuous leather processing machine having a movable processing tool similar to that shown in FIG. 1, the movable processing tool utilizing means of a cam and supports therewith.
Figure 3:
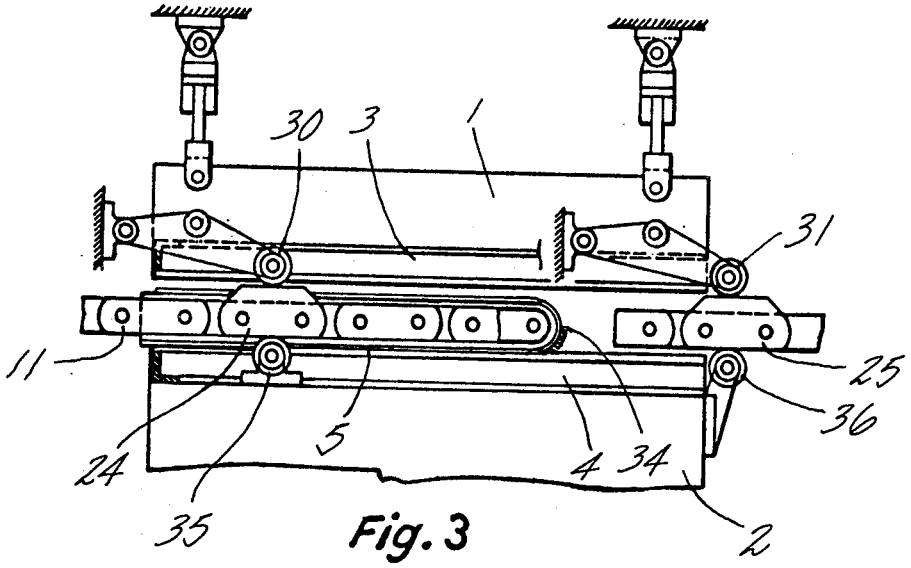

The raising and subsequent lowering of the processing tool 1 is governed by the positioning and the length of the cams 24 and 25, as shown in FIGS. 2 and 3. This occurs preferably when the leading end of the table plate 6 is approximately in the middle of the path between the processing tools 1 and 2, or in its second third of the path therebetween. Raising the upper processing tool 1 permits the hide 5 to be held firm by and with respect to the lower processing tool 2. That is, the hide 5 moves in relation to the table board 6. In this way the remaining unprocessed middle strip 34 rolls off to a certain extent onto the lower processing tool 2, with the result that now this middle strip comes into contact with the processing tools over its complete length, and the leading edge of the table board 6 is covered by an already processed part of the hide 5. When the rollers 30 and 31 at the rear end of the cams 24 and 25 slip away from the cams 24 and 25, the upper processing tool 1 moves downwardly and presses against the hide 5, whereby the middle strip 34 is processed by the lower processing tool 2, as it is subsequently moved thereagainst. In this work phase the processing tools 1 and 2 press the hide from both sides against the table board 6. An arrangement of lower support rollers 35 and 36 are provided so that the feed chain 11 cannot sag if the cams 24 and 25 lift the rollers, 30 and 31.

Figure 4:
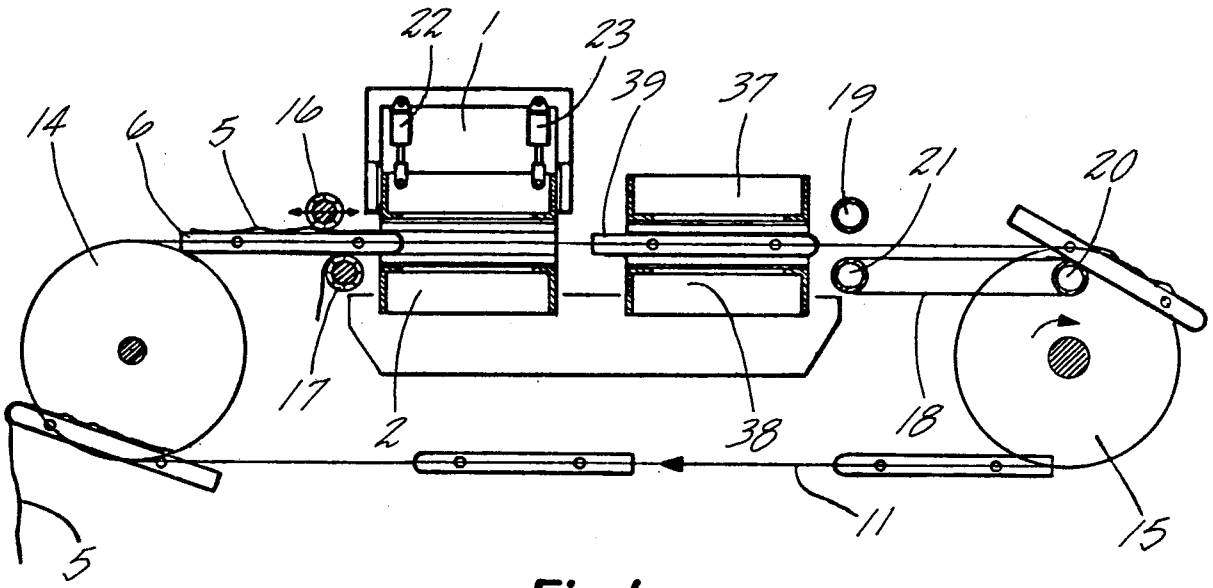
FIG. 4 shows a continuous leather processing machine in a side view, the machine comprising two pairs of processing tools.

The leather processing machine shown in FIG. 4 is an alternative embodiment of, yet is constructed similar to the machine which was shown in FIG. 1. The course of movement of the table board 6 and the hide 5 are similar in the embodiments of FIG. 1 and FIG. 4.

The displacement of the unprocessed middle strip in front of the front edge of the table board 6 occurs in the embodiment shown by FIG. 4, after passage of the front edge 34 through a first set of processing tools 1 and 2. The middle strip is then processed by a subsequent pair of processing tools 37 and 38. The subsequent processing tools 37 and 38 are mounted such that they continuously press against the table board 39 and hide 5, as they move between them.

Figure 5:
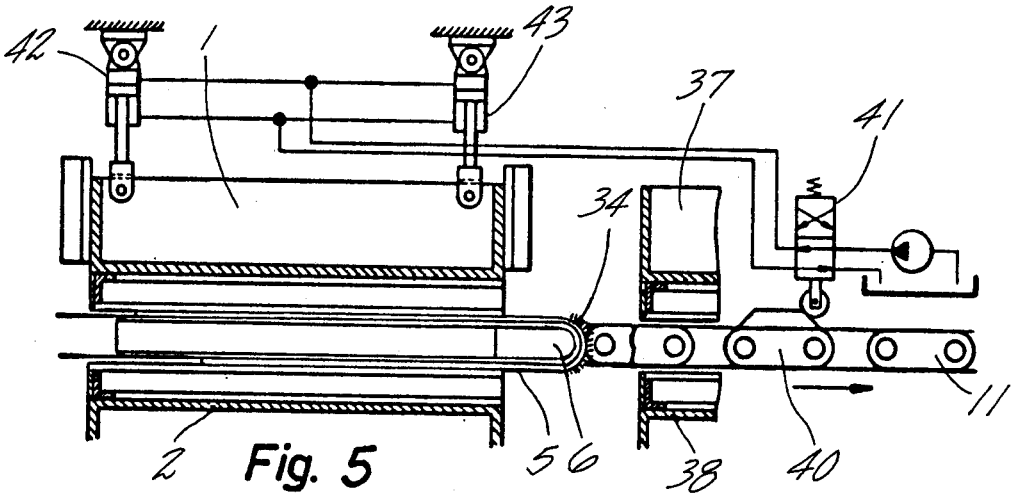
FIGS. 5 and 6 each show in a side view the displacement of the leather hides in the gap between the two pairs of processing tools be means of a hydraulic or pneumatically operated sensor mechanism.
Figure 6:
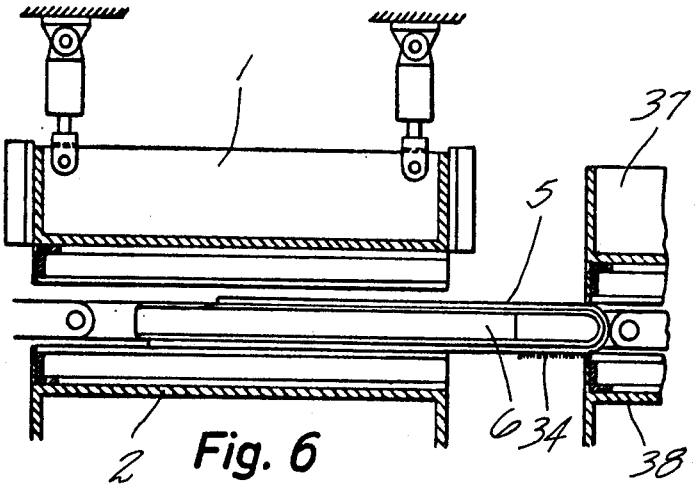

The displacement of the unprocessed middle strip 34 for this second embodiment occurs in the space between the first set of processing elements 1 and 2 and the second set of processing elements 37 and 38 as shown in FIGS. 5 and 6. The upper processing tool 1 in the first set of processing tools 1 and 2 may be raised similar to the raising of the upper processing tool 1, described according to FIG. 1, to initiate the displacement of the middle strip 34, in the second embodiment. As the middle strip 34 is situated between the two pairs of processing tools, the underside of the hide 5 is pressed further against processing tool 2 by the table board 6. The raising of the upper processing tool 1 in the first set of processing tools 1 and 2, is controlled here by a cam 40 arranged on the feed chain 11. The cam 40 controls a pneumatic valve 41, through which compressed air is fed to an arrangement of two piston cylinder units 42 and 43. The upper processing tool 1 is mounted on these piston cylinder units 42 and 43, and is raised from the table board 6 when compressed air is fed between the piston cylinder units 42 and 43. The position and length of the cam 40 effects the raising of the upper processing tool 1. The relowering of the upper processing tool 1 is effected before the front side of the table board 6 has entered the space between the second set of processing tools, 37 and 38.

FIG. 6 shows the workphase in which the front side of the table board 6 is just entering the space between the second set of processing tools 37 and 38 whereby the upper processing tool 1 of the first set of processing tools 1 and 2, is still in its upper position.

Lowering the displaced upper processing tool 1 exerts a force on the upper and underside of the hide 5, which ensures that the hide 5 can no longer shift in relation to the table board 6. The middle strip 34 being disposed on the underside of the table board 6, may then be processed accordingly by the lower processing tool 38 of the second set of processing tools, 37 and 38.

Figure 9:
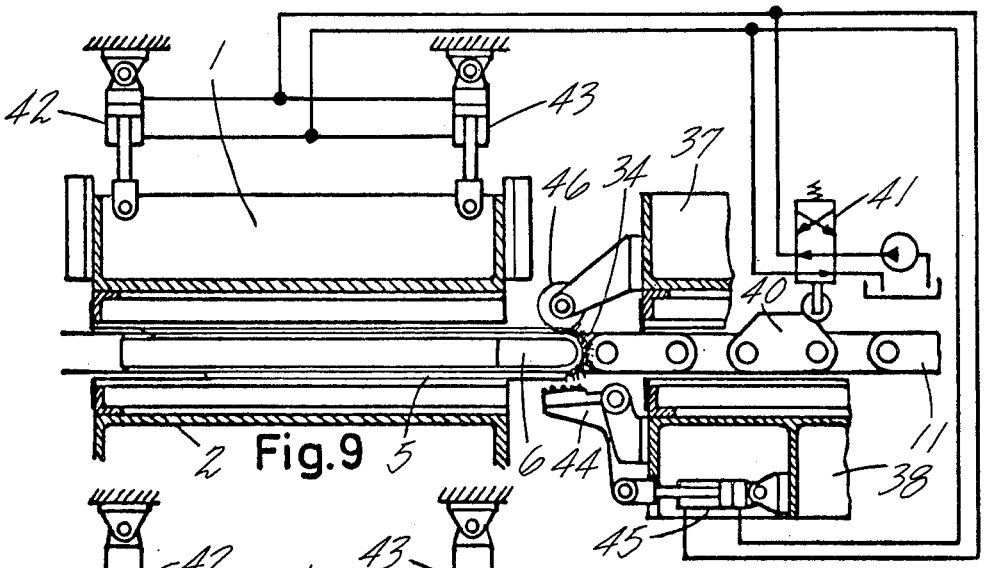
FIGS. 9 and 10 show an alternative embodiment to that shown in FIGS. 5 and 6, whereby in the gap between the pairs of processing tools the hides are additionally held firm on one side.
Figure 10:
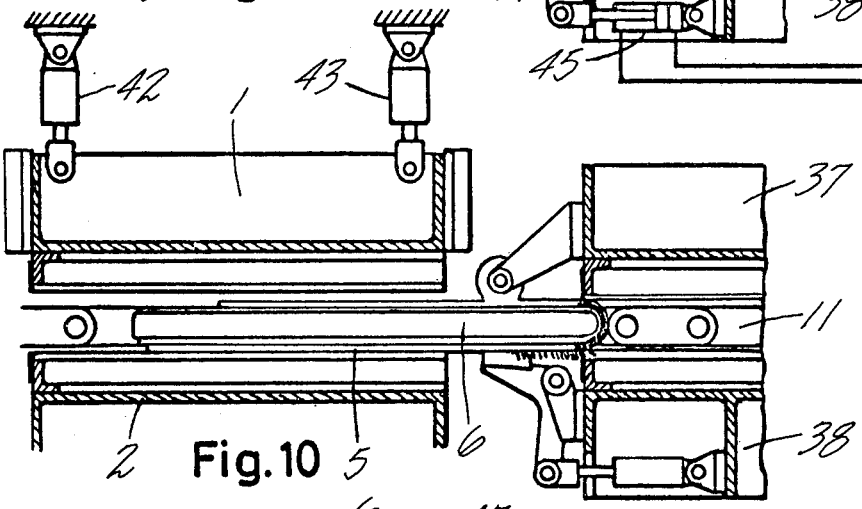
Figure 11:
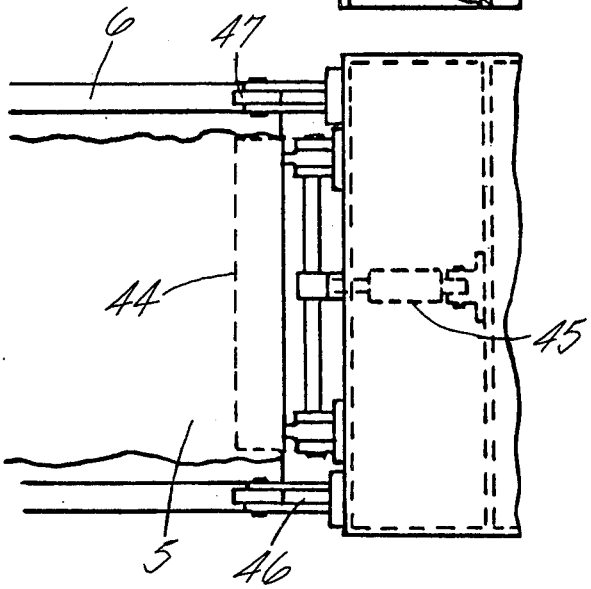
FIG. 11 shows a top view of the arrangement according to FIGS. 9 and 10.

A further embodiment is shown in FIGS. 9, 10 and 11, which contain a supplement to the machine shown in FIG. 5.

Figure 7:
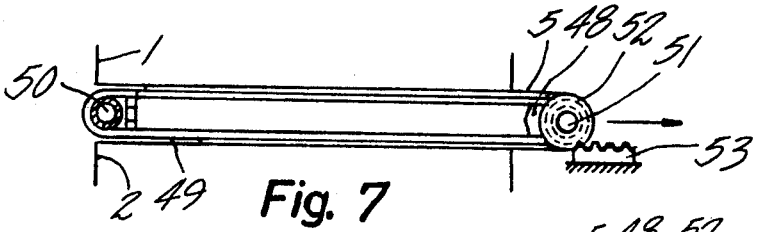
FIGS. 7 and 8 each show in a side view, the displacement of the leather hides by means of a pinion gear fitted to the table board, the gear interacting with a stationary rack.
Figure 8:
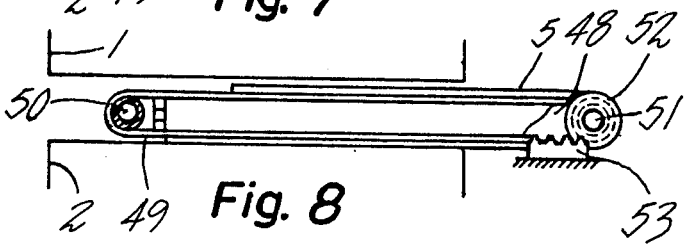

An additional hold back force for hides, which can not always easily be displaced in relaton to the table board due to their rigidity, is provided for by a stationary arranged brake element 44 which is disposed in the area between the first and second sets of processing elements 1 and 2, and 37 and 38, respectively. The brake element 44 is controlled by the pneumatic valve 41, through connection with a piston cylinder unit 45. If the valve 41 is operated by the cam 40, then not only the upper processing tool 1 lifts, as described, but the brake element 44 is lifted as well. The brake element 44 is forced against the hide 5 from below and holds the hide firmly in position. A support roller arrangement 46 and 47, as shown in FIGS. 9 and 11, is provided above the table board, opposite the brake element 44 to prevent the table board 6 from being raised from the feed chain 11. The support roller arrangement, 46 and 47, rolls off sideways along the hide 5 on the table board 6 and presses the table board 6 against the brake element 44. The subsequent introduction of the middle strip 34 between the second set of processing elements 37 and 38, occurs in the same way, as described for FIGS. 5 and 6. The brake element 44 extends transversely across the table board 6 and forms thereby a cross piece, which is dependent on the valve 41 being in contact with the cam 40. The brake element 44 may be adjustable in the heightwise direction. A further embodiment of the invention, for displacing the middle strip 34, in a manner as shown in FIGS. 7 and 8, consists in pulling a belt 49 around the table board, displaceable in relation to the middle strip. A table board 48, as shown in FIG. 7, is encompassed by the flexible belt 49 which is guided at the ends of the table board 48 over a pair of guide rollers 50 and 51. A pinion gear 52 is disposed on the axis of the guide roller 51. When the pinion gear 52 is driven, it takes the guide roller 51 with it, so that the flexible belt 49 executes a corresponding displacement in relation to the table board 48. The pinion gear 52 cooperates with a staionary rack 53, arranged downstream of and adjacent the first set of processing elements, 1 and 2. The rack 53 is arranged in such a relation to the processing tools 1 and 2, that the desired displacement of the flexible belt 49 occurs over a sufficient length in the area between the two pairs of processing elements, as described in FIG. 4. The displacement of the flexible belt 49 also causes the displacement of the hide 5 on the upper side of the table board 48. The underside of the hide 5 is held in place with respect to the lower processing tool 2, by means of contact with the same. Even the lower side of the flexible belt 49 carries out no movement in relation to the lower processing tool 2. This displacement of the hide 5 may occur, as shown in FIG. 8, while the processing element 1 is lifted away. The lifting of the upper processing element 1 may occur by the means described in conjunction with FIG. 5.

The flexible belt 49 as shown in FIGS. 7 and 8, is displaced accordingly with every cycle of the table board 48 in the machine, because of engagement of the pinion gear 52 with the rack 53. This permits other areas of the flexible belt 49 to come to rest on the front edge of the table board 48, where the belt is particularly under stress. This provides a certain balance of the stress of the belt over its length.

Figure 12:
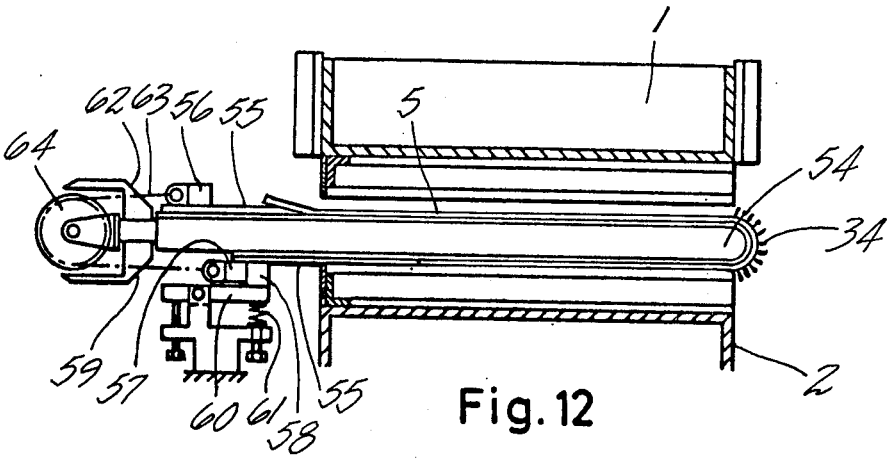
FIGS. 12 and 13 show the displacement of the hides by means of cams which are fitted to a belt drawn around the table board.
Figure 13:
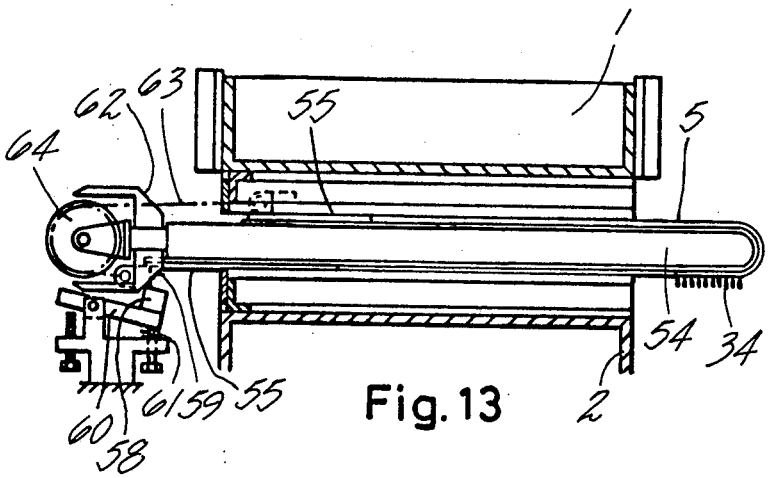

A further embodiment is shown in FIGS. 12 and 13 which also permit the displacement of a belt 55 in relation to a table board 54. The displacement is here however effected by a lower displacement cam 54, fitted to the belt 55. The lower displacement cam 57 starts straight towards a stationary arranged stop 58 during movement of the board 54 through the first set of processing tools 1 and 2. The displacement cam 57 is stopped, as well as the belt 55, with the result that the upper side of the belt 55 is pushed in a forward direction in relation to the table board 54. The upper processing tool 1 may be lifted up, as was described, by a control mechanism shown in FIG. 5. Displacement of the belt 55 causes the middle strip 34 to arrive at the underside of the table board 54 as shown in FIG. 13. Displacing the belt 55 in relation to the table board 54 lasts until a release cam 59 on the reverse side of the table board 54 runs up to the stop 58. The stop 58 is pivotally mounted on a lever 60 and is constantly pressed by a spring 61 into the horizontal position shown in FIG. 12. The release cam 59 has a bevelled edge which runs up to the stop 58 which will be pressed downwards to release the lower displacement cam 57. The displacement of the belt 55 is effected and the process tool can be raised, the hides can be drawn along by the table board 54 all as stated earlier. The middle strip 34 has taken up the position shown in FIG. 13, in which it can be processed by a subsequent pair of processing tools not shown.

After cycling the hide 5, the belt 55 may be brought into its original position as shown in FIG. 12. An upper displacement cam 56 is provided, which is fixed to the belt 55 similar to the lower displacement cam 57 to the belt 55, on its upper side in relation to the table board 54. This upper displacement cam 56 works in conjunction with a stop not shown, which is fitted behind both pairs of processing tools and holds this firm when meeting with the displacement cam 56, until a release cam 62 arrives at the non-shown stop. The same release operations occur as described previously in connection with the release of the lower displacement cam 57. The resultant movement of the upper displacement cam 56 corresponds with that of the lower displacement cam 57, wherein the belt 55 is pushed away in the reverse direction to the table board 54. A cable 63 is fitted onto the displacement cams 56 and 57, running over a guide roller 64, so that the belt 55 has a friction-type locking arrangement at the rear end of the table board 54. When one of the displacement cams 56 or 57 is moved, the cable 63 makes a corresponding displacement movement.

In order to facilitate the slipping of a hide as processing stock in relation to the table board, one can cover the table board with a cover attached thereto. An elastic underlay is provided between cover or belt and the table board in order that this cover or belt can yield as it is pulled around the table board, to facilitate moving or displacement of hides which are often uneven in thickness.

Though the invention has been described with a certain degree of particularity, it is intended to be interpreted as exemplary only, and not in a limiting sense.

We claim:

1. A machine for the continuous processing of hides, comprising:

a table board guided longitudinally through an arrangement of processing tools disposed opposite each other, wherein each hide is disposed approximately in the middle thereof around the front edge of said table board;

means for displacing said hide with respect to said table board to permit the middle strip of hide which covered the front edge of said table board to be displaced for processing thereof;

said processing tools include a first processing tool and a second processing tool;

said second tool being in contact with said hide for a period of time to effectuate said displacement of said hide with respect to said table board, by at least the width of the front edge of the table board.

2. A machine for the continuous processing of hides as recited in claim 1, wherein said arrangement of processing tools comprises at least a first pair of processing tools and a second pair of processing tools, said first pair of processing tools includes an upper tool and a lower tool, said upper tool being arranged to be raisable from said table board;

said second pair of processing tools being arranged to permit entry of said table board and hide therebetween immediately after displacement of said hide with respect to said table board, the remainder of said hide thereupon being processed by said first pair of processing tools and fully processed by said second pair of processing tools.

3. A machine for the continuous processing of hides as recited in claim 1, wherein the time required for displacing said hide with respect to said table board elapses before said table board and hide begin to pass between said second pair of processing tools.

4. A machine for the continuous processing of hides as recited in claim 1 wherein said table board has a cover disposed therearound.

5. A machine for the continuous processing of hides as recited in claim 1, wherein said table board has a displaceable belt disposed therearound.

6. A machine for the continuous processing of hides as recited in claim 4, wherein said cover is comprised of an elastic material.

7. A machine for the continuous processing of hides as recited in claim 6, wherein said machine includes:

a feed mechanism for driving said table boards between said processing tools;

a cam mechanism disposed on said feed mechanism to activate a biased sensor mechanism to effectuate a mechanism for the raising and subsequent lowering of said processing tool.

8. A machine for the continuous processing of hides as recited in claim 7, wherein said sensor mechanism comprises a biased valve which when tripped by said cam, activates a pair of pressurizable pistons to raise said processing tool from said table board.

9. A machine for the continuous processing of hides as recited in claim 8, wherein said cam disengages with said valve to deactivate said pressurizable pistons to lower said processing tool against said table board.

10. A machine for the continuous processing of hides as recited in claim 9, which includes a pair of spreader rollers, arranged in front of the first pair of processing tools wherein the hide contacts each spreader roller both above and below the table board, and is pressed thereagainst, simultaneously.

11. A machine for the continuous processing of hides as recited in claim 10, which includes a pair of stationary pressure rollers arranged immediately behind the first pair of processing tools above and below the track of the table board, which press the hide to help overcome the holdback force of the first pair of processing tools.

12. A machine for the continuous processing of hides as recited in claim 11 included a circulating transport belt disposed behind the first pair of processing tools and underneath said table board to provide support for the processed hide hanging below the table board.

13. A machine for the continuous processing of hides, comprising:

a table board guided longitudinally through an arrangement of processing tools disposed opposite each other, wherein each hide is disposed approximately in the middle thereof around the front edge of said table board;

said processing tools comprising an upper processing tool and a lower processing tool;

means for displacing said hide with respect to said table board wherein said table board has a pinion gear rotatably mounted on its front end on a guide roller;

said table board having a second guide roller mounted on its back end;

a movable cover disposed over said guide rollers between said hide and said table board;

a stationary rack which comes into limited engagement with said pinion gear to effectuate a limited displacement of said hide with respect to said table board, moving the front edge of said hide around to the bottom side of the table board to be processed by a processing tool;

said upper processing tool being raisable with respect to said table board during the displacement of said hide.

* * * * *